United States Patent [19]

Kramer et al.

[11] 4,336,003

[45] Jun. 22, 1982

[54] CRANE SWING CONTROL

[75] Inventors: William D. Kramer, Powell; Ellis H. Born, Columbus, both of Ohio

[73] Assignee: Abex Corporation, New York, N.Y.

[21] Appl. No.: 177,021

[22] Filed: Aug. 11, 1980

[51] Int. Cl.[3] ..... F04B 49/08

[52] U.S. Cl. ..... 417/217; 60/444; 417/218

[58] Field of Search ..... 60/444, 452, 445, 443; 417/218-222, 217

[56] References Cited

U.S. PATENT DOCUMENTS

| | | | |
|---|---|---|---|
| 3,904,318 | 9/1975 | Born et al. | 417/199 |
| 3,908,519 | 9/1975 | Born et al. | 417/222 X |
| 3,999,387 | 12/1976 | Knopf | 60/444 |
| 4,013,380 | 3/1977 | Pensa | 60/444 |
| 4,076,459 | 2/1978 | Adams et al. | 417/218 X |

*Primary Examiner*—Carlton R. Croyle
*Assistant Examiner*—Edward Look
*Attorney, Agent, or Firm*—Thomas S. Baker, Jr.; David A. Greenlee

[57] ABSTRACT

A control for a variable displacement pressure compensated pump in which pressurized control fluid regulates the setting of a sequence valve to set the maximum output pressure of the pump and also set the displacement of the pump. The sequence valve is a two-stage device which utilizes a sequence poppet stage and cone stage. When working fluid pressure exceeds the setting of the sequence valve, the cone stage spills to reduce the displacement of the pump. If the pressure is not reduced fast enough the sequence poppet spills to more rapidly reduce the displacement of the pump.

2 Claims, 6 Drawing Figures

M
T
T
REL
P1
P2

CRANE SWING CONTROL

BACKGROUND OF THE INVENTION

This invention relates to a hydraulic control system for controlling the swing of a boom and cab mounted on a swing table of a hydraulically operated crane.

In mobile and stationary cranes it is necessary to swing the cab and boom in order to pick up, move or to set down a load. A swing table may be rotated through a system which is mechanical, such as where a prime mover is connected through a gear system to the swing table, or through a system which is mechanical and hydraulic, such as where a prime mover drives a pump which, in turn, drives a hydraulic motor connected to the swing table. Whenever the swing table is rotating, it is important that the boom always be centered over the load. If the load leads or follows the end of the boom, it is likely that the load will begin to oscillate about the end of the boom resulting in the load hitting something.

When a load is initially lifted and accelerated, the crane operator can normally control the speed of the rotation of the boom sufficiently to prevent the boom from moving out of alignment with the load. A problem arises when it is desired to decelerate the boom and load. If the rotation of the swing table is slowed at too great a rate, the load will begin to lead the boom and begin to oscillate. Consequently, it is desirable to have a system which will provide the minimum amount of drag on the components which are connected to the swing table and will allow the table to swing free and follow the load.

One method for driving a swing table is to have a prime mover drive a torque converter which is geared to the swing table. A problem with using a torque converter to control the rotation of a swing table is the cost of the torque converter. Torque converters are complex transmissions which are extremely expensive.

Another common method of moving a swing table is to have a prime mover drive a fixed displacement pump which, in turn, drives a fixed displacement hydraulic motor having a pinion gear on an output shaft which is meshed with a large bull gear on the crane swing table. Special directional proportional control valves are used to control the flow of fluid from the hydraulic pump to the motor. A problem with using a fixed displacement pump and directional proportional control valves is that a great deal of energy is lost during deceleration of the system.

It is desirable to provide a system for rotating a swing table that is less expensive than a mechanical system incorporating a torque converter and is more efficient than a hydraulic system incorporating fixed displacement pumps and directional proportional control valves.

SUMMARY OF THE INVENTION

The instant invention provides a control system for rotating a crane swing table in which a variable displacement hydraulic pump driven by a prime mover operates a fixed displacement hydraulic motor having a pinion on an output shaft which is meshed with a bull gear on the swing table. In this system a proportional pressure reducer valve regulates the pressure of control fluid which is supplied to a piston operating a displacement control on the pump. The magnitude of the pump displacement is proportional to the pressure of the control fluid. In addition, the control fluid pressure regulates the setting of a pressure compensator control to set the maximum output pressure of the pump. The pressure compensator control is a two-stage device which utilizes a sequence poppet stage and a cone stage. A hydraulic piston acted upon by the control fluid provides the setting for the cone stage. This setting is proportional to the pressure of the control fluid. In the event the pressure of the working fluid is excessive, the cone stage spills. If the amount of fluid which must be spilled cannot be accommodated by the cone stage, the poppet stage will subsequently spill to more rapidly reduce the displacement of the pump.

DESCRIPTION OF THE PREFERRED EMBODIMENT

Figure 1:
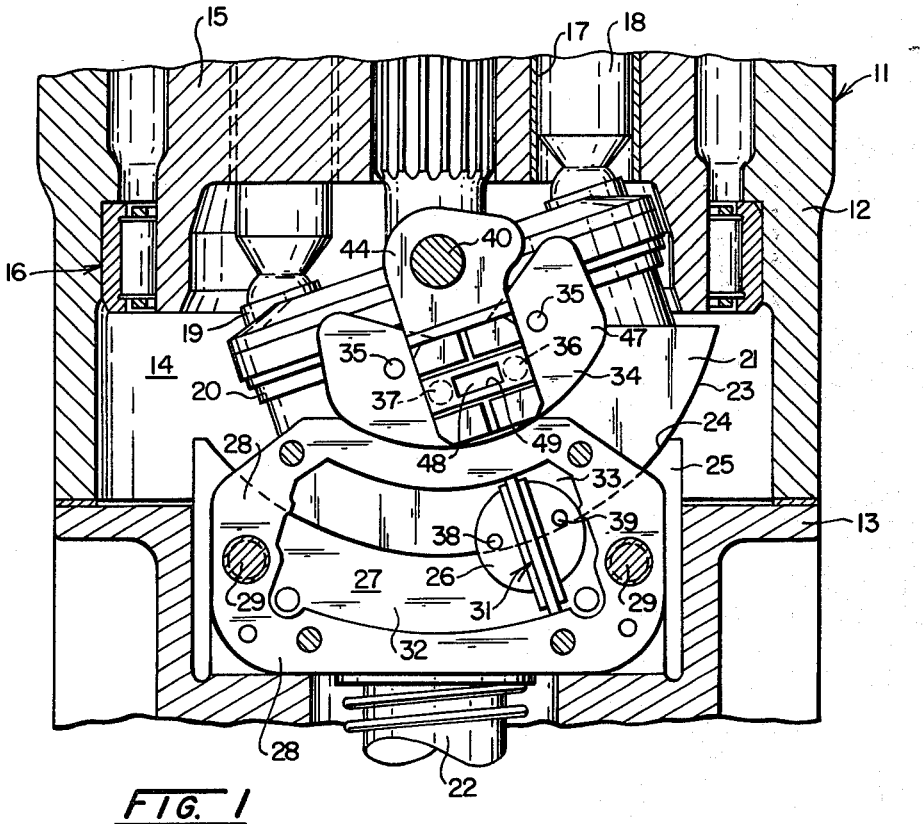
FIG. 1 is a part sectional view of a hydraulic pump and a portion of a manual displacement control device therefor.

Referring to FIG. 1, an axial piston pump has a case 11 which includes a central housing 12, an end cap 13 at one end and a port cap, not shown, at the other end. Case 11 may be fastened together by bolts or other known means.

Case 11 has a cavity 14 in which a rotatable cylinder barrel 15 is mounted in a roller bearing 16. Barrel 15 has a plurality of bores 17 equally spaced circumferentially about the rotational axis of the barrel 15. A piston 18 having a shoe 19 is mounted in each bore 17.

Each shoe 19 is retained against a flat creep or thrust plate 20 mounted on a movable rocker cam 21 by a shoe retainer assembly fully described in U.S. Pat. No. 3,904,318 assigned to the assignee of the instant invention.

Referring again to FIG. 1, rotation of a drive shaft 22 by a prime mover, such as an electric motor, not shown, will rotate barrel 15. If rocker cam 21 and thrust plate 20 are inclined from a neutral or centered (minimum fluid displacement) position normal to the axis of shaft 22, the pistons 18 will reciprocate as shoes 19 slide over plate 20 in a well known manner. Fluid displacement increases as the inclination of thrust plate 20 increases.

The mechanism for changing the displacement of the pump will now be described. Rocker cam 21 has an arcuate bearing surface 23 which is received in a complementary surface 24 formed on a rocker cam support 25 mounted in end cap 13. Rocker cam 21, which carries thrust plate 20, is moved relative to support 25 by a pair of fluid motors. Although this description refers to the fluid motor on the left side of rocker cam 21, as viewed in FIG. 3, it applies equally to the fluid motor on the right side of rocker cam 21 and identical components will be noted with identical primed numbers.

The fluid motor includes a vane 26 formed integrally with the side of rocker cam 21 so as to be rigidly secured thereto and movable therewith. The vane 26 projects laterally from the side of rocker cam 21 into a vane chamber 27. Chamber 27 is formed by a vane housing 28 which is attached to rocker cam support 25 by bolts 29. A cover 30, shown in FIG. 3, closes the end of housing 28 and is secured by bolts 29. As thus assembled, vane 26 and a seal assembly 31 divide chamber 27 into a pair of expansible fluid chambers 32, 33 to form a fluid motor.

The fluid motor is operated by supplying pressurized fluid to one of the chambers 32, 33 and simultaneously exhausting fluid from the other chamber 32, 33 to move vane 26 within chamber 27. The operation of the fluid motor is controlled by a servo or follow-up control valve mechanism which regulates the supply of pressurized fluid to chambers 32, 33. The mechanism includes a fluid receiving valve plate 34 rigidly mounted on rocker cam 21 by bolts 35. Valve plate 34 and vane 26 move along concentric arcuate paths when rocker cam 21 is moved.

Valve plate 34 has a pair of ports 36, 37 which are connected to respective fluid chambers 32, 33 through a pair or drilled passageways 38, 39 which terminate in vane 26 on either side of seal assembly 31.

For counterclockwise operation of the fluid motor, as viewed in FIG. 1, pressure fluid is supplied to port 36 and flows through passageway 38 into chamber 32 to move vane 26 and rocker cam 21 counterclockwise. Expansion of chamber 32 causes chamber 33 to contract and exhaust fluid through passageway 39 and out of port 37 and into the pump casing.

For clockwise operation of the fluid motor, the fluid flow is reversed, pressure fluid is supplied to port 37, flows through passageway 39 and expands chamber 33 to move vane 26 and rocker cam 21 clockwise. Chamber 32 contracts and exhausts fluid through passageway 38 out of port 36 and into the pump casing.

Figure 2:
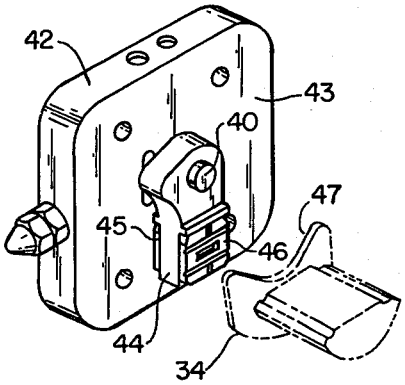
FIG. 2 is a perspective view showing the inner side of a cover plate which houses a manual displacement control device for the hydraulic pump of FIG. 1.
Figure 3:
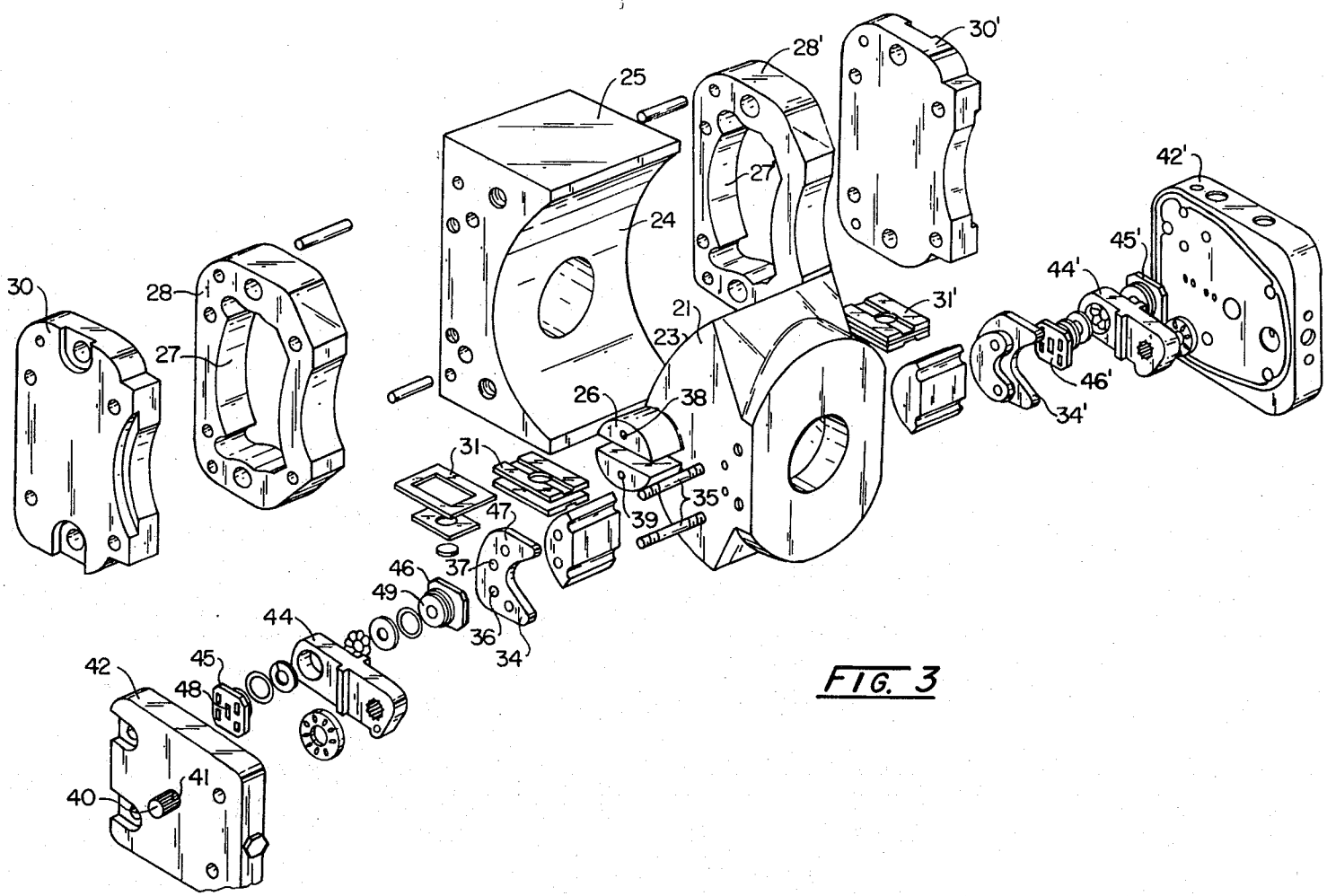
FIG. 3 is an exploded view of the manual displacement control system shown in FIG. 1.

Referring to FIGS. 1–3, that portion of a servo control valve mechanism which selectively supplies fluid to ports 36, 37 in valve plate 34 will now be described. An input shaft 40 is mounted in a bore 41 in a cover plate 42. FIG. 2 shows the flat inner surface 43 (i.e., the surface that overlies valve plate 34) of cover 42. Cover plate 42 is attached to housing 12 by bolts, not shown. An arm 44 positioned on the inside of cover plate 42 is fastened to input shaft 40. An input valve member includes a pair of identical valve shoes 45, 46 which are received in a bore in arm 44. Shoe 45 rides on flat inner surface 42 of cover plate 42 and shoe 46 rides on a flat surface 47 of valve plate 34. Each shoe 45, 46 has a central port 48, 49, respectively, which receives servo fluid from a port, not shown, in cover plate 42.

Operation of the fluid motor by the servo control valve mechanism to change the displacement of the pump will now be described. When the fluid motor is at rest, fluid port 49 in shoe 46 lies between valve plate ports 36, 37 and the ports are covered by flats on the shoes. To change the displacement of the pump, input shaft 40 is rotated in the direction rocker cam 21 is to pivot. If input shaft 40 is rotated clockwise, as viewed in FIG. 1, shoe 46 is moved clockwise and port 49 (which is in fluid communication with port 48 in shoe 45 and the servo fluid supply port in cover plate 42 under all conditions) is aligned with port 37 while port 36 is uncovered. Pressure fluid flows from port 37 through passageway 39 into chamber 33. Simultaneously, fluid exhausts from chamber 32 through passageway 38 and out of uncovered port 36. Rocker cam 21 is pivoted counterclockwise in a similar manner when input shaft 40 is moved counterclockwise to align port 49 with valve plate port 36.

Accurate follow-up is provided since angular movement of rocker cam 21 and valve plate 34 is equal to that of input shaft 40. When rocker cam 21 and valve plate 34 are moved through the same angle as input shaft 40, port 49 is centered between ports 36, 37, flats on shoe 46, cover ports 36, 37 and the fluid motor is stopped.

Figure 4:
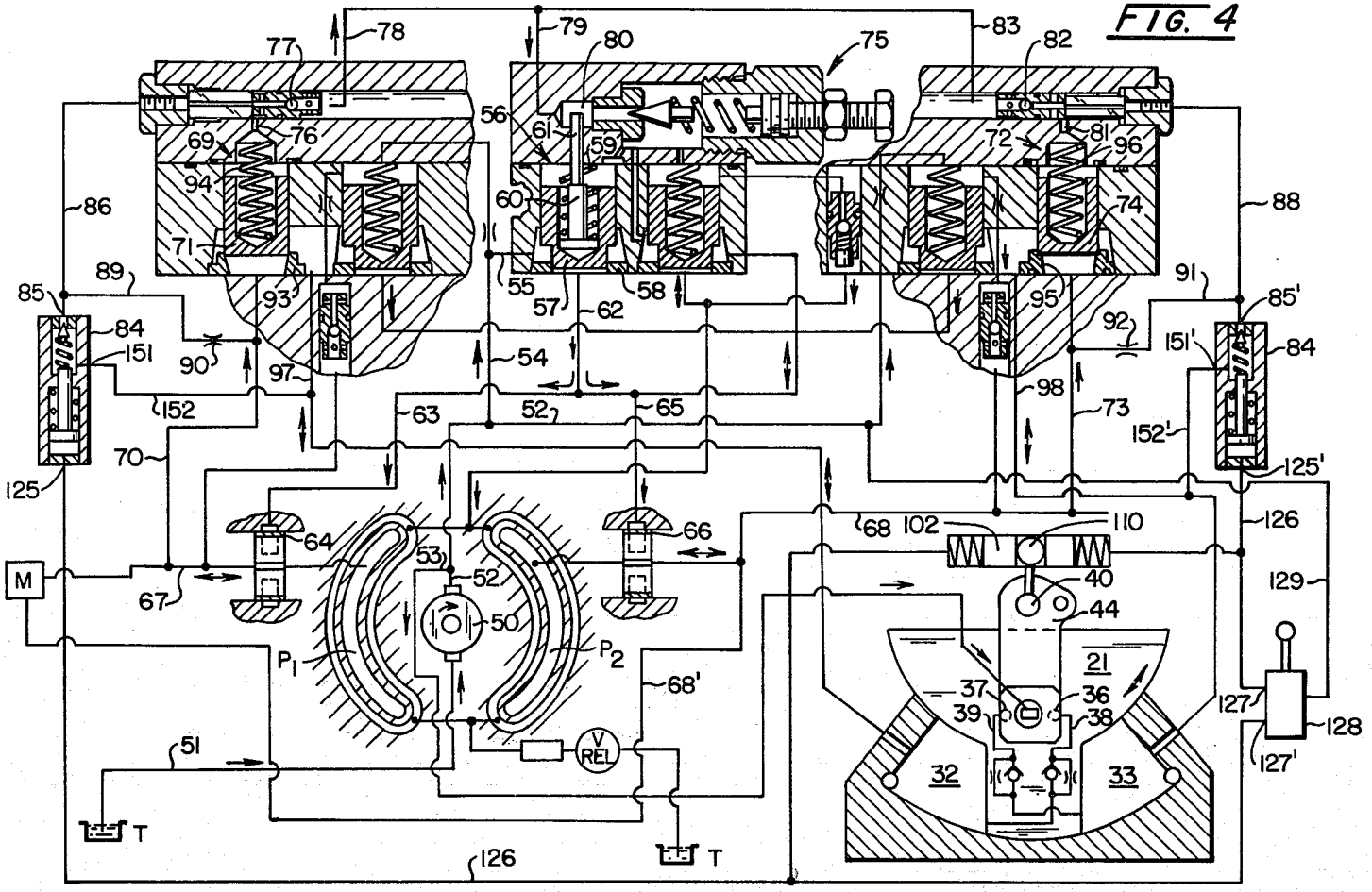
FIG. 4 is a sectional view of the valve block for the automatic control of the pump and a schematic diagram of the hydraulic circuitry for the automatic and manual control systems for the pump including the crane swing of the instant invention.

The above described manual control system is supplemented by an automatic control system which will now be described. This system is described in greater detail in U.S. Pat. No. 3,908,519 assigned to the assignee of the instant invention and incorporated by reference herein. Referring to FIG. 4, fluid in tank T is supplied to the intake side of servo pump 50 through line 51. Servo pressure fluid is exhausted from pump 50 through line 52. Line 52 is intersected by line 53 which is connected to the port in cover plate 42. Fluid in line 53 exhausts from the port in cover plate 42 and flows to the manual pump control for operation of the pump displacement control motor, as described above.

Lines 54, 55 connect line 52 to a pressure modulated servo relief valve 56 in which servo pressure fluid acts against a poppet 57 which is biased against a seat 58 by both a spring 59 and a plunger 60 operated by piston 61. Working pressure fluid is supplied to the top of piston 61 so that the force supplied by it to the plunger 60 and poppet 57 is modulated by variations in the pressure of the working fluid. For example, at a working fluid pressure of 0 psi, relief valve 56 is set at approximately 300 psi, but at a working pressure of 5000 psi, relief valve 56 is set at approximately 500 psi.

When servo fluid pressure exceeds the force of spring 59 and plunger 60, poppet 57 lifts from seat 58 and fluid spills into a replenishing circuit which includes line 62, feed line 63 to check valve 64 and feed line 65 to check valve 66. Check valves 64, 66 are located in lines 67, 68, respectively, from main pump ports $P_1$, $P_2$. If the low pressure port does not have an adequate supply of fluid, the check valve in that port opens to supply replenishing fluid to prevent cavitation of the pump.

When working pressure fluid is in port $P_1$ it is supplied to one port of a fluid motor M through line 67. Fluid motor M has an output shaft with a pinion which is meshed with a bull gear mounted on a crane swing table, not shown. Consequently, when working pressure is supplied to line 67, fluid motor M is operated and the crane swing table is rotated in one direction. A sequence valve 69 controls the pressure of the working fluid in main pump port $P_1$. Port $P_2$ is the low pressure port when working pressure fluid is in port $P_1$.

When working pressure fluid is in port $P_2$ it is supplied to the other port of motor M through lines 68, 68'. When working pressure fluid is supplied to lines 68, 68', the fluid motor M is operated and the crane swing table is rotated in the other direction. A sequence valve 72 controls the pressure of the working fluid in pump port $P_2$.

An adjustable pilot stage 75 controls the pressure setting of the sequence valves 69, 72. Pilot stage 75 is connected to an orifice 76 in the top of valve 69 through a check valve 77, line 78, line 79 and cavity 80. Pilot stage 75 is connected to an orifice 81 in the top of valve 72 through a check valve 82, line 83, line 79 and cavity 80. The crane swing control 84 of the instant invention also has pilot stages which control the pressure setting of the sequence valves 69, 72, which will be described below. Control 84 has one port 85 connected to the top of valve 69 through a line 86 and another port 85' connected to the top of valve 72 through a line 88.

Sequence valve 69 includes a poppet 71 which is biased against a seat 93 by a spring 94. Sequence valve 72 includes a poppet 74 which is biased against a seat 95 by a spring 96. When port $P_1$ has working pressure fluid, the fluid in line 67 is supplied to the bottom of poppet 71 through line 70 and to line 86 through line 70, an orifice 90 and line 89. Consequently, working pressure fluid is present at port 85 of crane swing control 84 and at cavity 80 of pilot stage 75. Likewise, when working pressure fluid is in port $P_2$, the fluid in line 68 is supplied to the bottom of poppet 74 through line 73 and is connected to line 88 through line 73, and orifice 92 and line 91. Therefore, working pressure fluid is supplied to crane swing control port 85' and to cavity 80 of pilot stage 75.

When working pressure fluid in port $P_1$ exceeds the setting of pilot stage 75 or of the pilot stage of the crane swing control 84, fluid begins to flow through orifice 90. When there is sufficient flow to reduce the pressure of the fluid on top of poppet 71 enough to offset the force of spring 94, poppet 71 lifts from seat 93 and working pressure fluid spills through valve 69. Some of the spilled working fluid flows through line 97 to fluid motor chamber 32 and operates the fluid motor to move rocker cam 21 towards the neutral position to reduce the displacement of the pump until working fluid pressure is just sustained at the setting of valve 69.

Likewise, when working pressure fluid in port $P_2$ exceeds the setting of either pilot stage 75 or a pilot stage in crane swing control 84, fluid flows through orifice 92. When there is sufficient flow to reduce the pressure of the fluid on top of poppet 74 enough to offset the force of spring 96, poppet 74 lifts from seat 94 and working pressure fluid spills through valve 72. Some of the spilled fluid flows through line 98 to fluid motor chamber 33 and operates the fluid motor to reduce the displacement of the pump until working fluid pressure is just sustained at the setting of valve 72.

Figure 5:
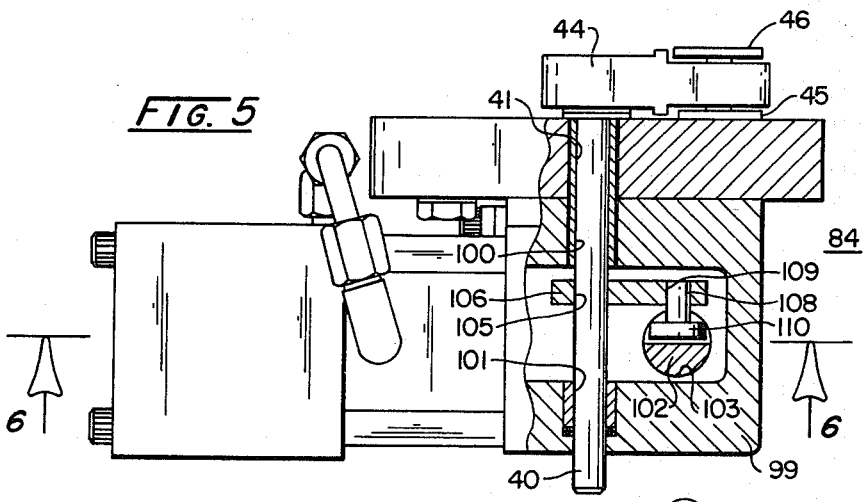
FIG. 5 is a part sectional view of the crane swing control of the instant invention.
Figure 6:
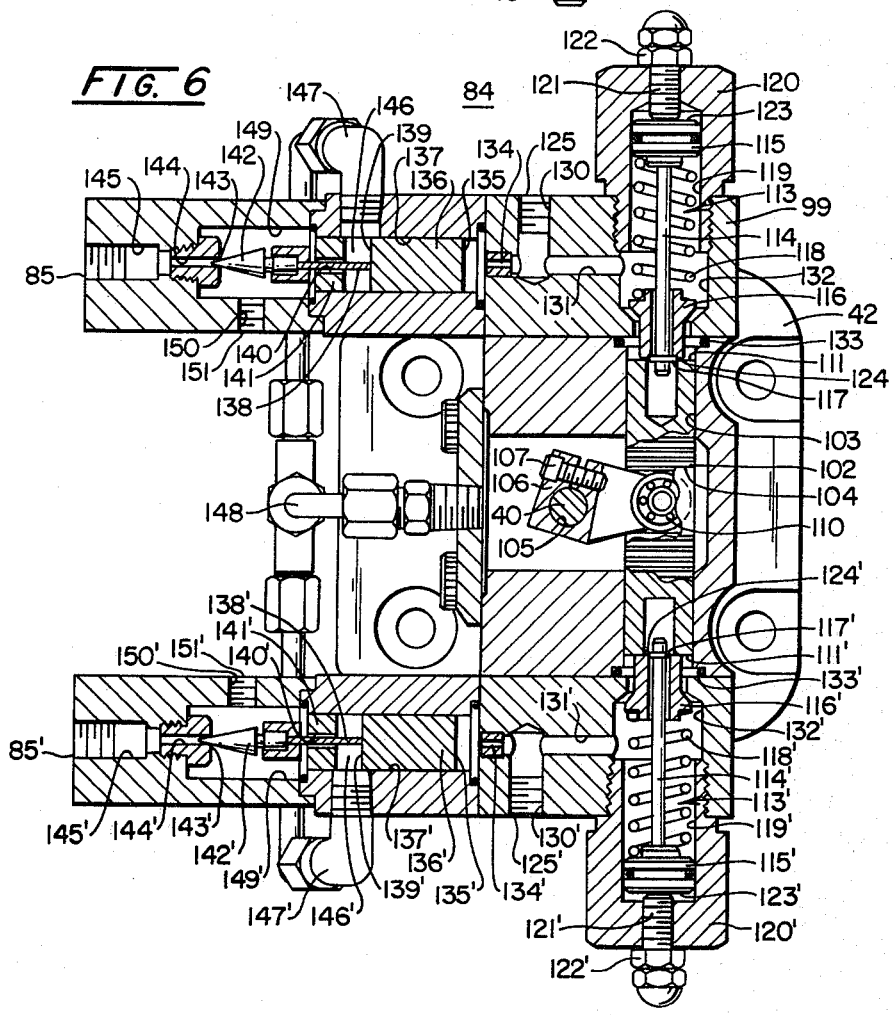
FIG. 6 is a view along line 6—6 of FIG. 5.

Referring to FIGS. 5 and 6 of the drawings, the crane swing control 84 of the instant invention will now be described. In FIG. 6 it can be seen that if the crane swing control 84 is bisected by a horizontal line passing through input shaft 40, the portion of the control valve below the line is a mirror image of that portion of the control which is above the line. This is because the control 84 operates on an across-center pump and a duplicate set of controls is necessary to control the working pressure fluid for each of the ports $P_1$, $P_2$. This description will refer to that part of the control which sets the displacement of the pump and controls the setting of the sequence valve 69 when working pressure fluid is in port $P_1$. Identical elements of the control which operate when working pressure fluid is in port $P_2$ will be referred to by identical primed numbers.

In addition to providing a second setting for the maximum working pressure of the pump by providing a second setting for the sequence valves 69, 72, the crane swing control 84 of the instant invention also sets the displacement of the pump.

Control 84 includes a housing 99 which is attached to the outer surface of cover plate 42 by bolts, not shown. Manual input shaft 40, which sets the displacement of the pump, projects into housing 99 through a bore 100 on one side of the housing and exits from the housing through a bore 101 on the opposite side of the housing. Input shaft 40 passes through a bore 105 in one end of a drive arm 106. Drive arm 106 is secured to shaft 40 by a bolt 107. One end of a shaft 108 is pressed into a bore 109 in the other end of drive arm 106 and a bearing 110 is mounted on the other end of shaft 108.

A control piston 102 is mounted in a bore 103 in housing 99. A slot 104 is formed in the center of the control piston 102. Bearing 110 is captured in slot 104 of control piston 102 such that movement of the control piston 102 in bore 101 causes input shaft 40 to rotate.

Each end 111 of control piston 102 is engaged by a cartridge assembly 113. Cartridge assembly 113 includes a spring guide 114 which is mounted on a base 115 and a movable spring stop 116 which is retained on spring guide 114 by a clip 117. A spring 118 having a force of approximately 28 lbs. biases stop 116 against clip 117.

Cartridge assembly 113 is mounted in a bore 119 of a cartridge housing 120. Cartridge housing 120 is mounted in control housing 99 in axial alignment with control piston bore 102. An adjustment screw 121 engages one end 123 of base 115 and is tightened sufficiently that the bottom end 124 of spring stop 116 just touches the end 111 of control piston 102 when piston 102 is in the neutral or centered position. In this position, input shaft 40 is at a position of zero pump displacement. A lock nut 122 maintains the adjustment of screw 121. Likewise, adjustment screw 121' engages one end 123' of base 115' and is adjusted so that the bottom end 124' of spring stop 116' just touches the end 111' of control piston 102 when it is in the neutral position. Thus, it can be seen that the cartridge assemblies 113, 113' serve to maintain control piston 102 and input shaft 40 in the neutral position and that a force in excess of 28 lbs. acting on either end of the control piston 102 is required in order to move the control piston 102 out of the neutral position to thereby put the pump on stroke.

In order to move the control piston 102 out of the neutral position to put the pump on stroke, control pressure fluid is supplied to port 125 from a line 126 which is connected to an outlet port 127 of a manual proportional pressure reducer valve 128. Servo pressure fluid in line 52 is supplied to the inlet port of valve 128 through line 129. The valve 128 is bi-directional with a centrally located neutral position of zero control fluid pressure. As the valve moves from the neutral position towards the full pressure position on either side of center, the pressure of the control fluid changes from zero to the maximum setting of the valve in direct proportion to the amount the valve is moved between the zero and full pressure positions. In the instant invention, it has been found desirable to adjust valve 128 to have a maximum control fluid pressure of 330 psi when the handle is in the full pressure position on either side of center.

Control pressure fluid in port 125 flows through a bore 130, a drilled passage 131 and into an enlarged bore 132 for the cartridge assembly 113. The fluid in bore 132 flows around the outside of spring stop 116 to the end 111 of control piston 102.

The displacement of piston 102 is proportional to the pressure of the control fluid. When the pressure acting on piston 102 produces a force in excess of 28 lbs., the piston 102 moves on stroke. When the pressure of the fluid acting on piston 102 is 330 psi, end 111' engages a shoulder 133' projecting into bore 103 and the pump is in the full displacement position. In a similar manner, if control pressure fluid is in port 125', control piston 102 moves off center in the other direction.

The portion of the crane swing control 84 which provides the setting for the sequence valves 69, 72 will now be described. In control 84, port 125 is connected through an orifice 134 to one end 135 of a pilot piston 136 which is movable in an axial bore 137. A rod 138 projects from the other end 139 of piston 136. The rod 138 projects through a bore 140 in a seal assembly 141 and has a cone 142 mounted on its end. The cone 142 seats on the edge 143 of a bore 144 when pressure is acting on the end 135 of piston 136. Bore 144 is connected to a passage 145 which opens into port 85. As previously mentioned, the ports 85, 85' are connected to the downstream side of the orifices 90, 92 which reduce the pressure on top of the poppets 71, 74 to allow them to lift and spill the sequence valves 69, 72 when there is sufficient flow through the orifices 90, 92. Consequently, when control pressure fluid is acting against the end 135 of pilot piston 136, cone 142 sets sequence valve 69. In the instant invention, the area of bore 137 was made approximately ten times that of bore 134. However, the ratio can be any number within the physical confines of the valve. Consequently, cone 142 will provide a setting for sequence valve 69 equal to approximately ten times the pressure in bore 137. As previously mentioned, the pressure of the control fluid in port 125 ranges between zero and 330 psi. Consequently, when control pressure fluid is in port 125, pilot piston 136 is moved to the left and cone 142 seats on edge 143 and provides a sequence valve setting of ten times that of the control fluid.

An isolation chamber 146 is formed in bore 137 between seal assembly 141 and the rod end of piston 136. Chamber 146 is connected to fluid at low pressure through a tube 147 which connects with another tube 148 which opens into the case adjacent drive arm 106. This enables pilot piston 136 to move solely in response to the pressure of control fluid acting on end 135. Since the force of pilot piston 136 against seat 143 is directly proportional to the pressure of the control fluid, the setting of sequence valve 69 is directly proportional to the pressure of the control fluid. Since the ratio of the areas of pilot piston bore 137 to cone seat bore 144 is 10:1, the setting of sequence valve 69 ranges between 0 and 3300 psi as the pressure of the control fluid ranges between 0 and 330 psi.

Operation of the crane swing control 84 of the instant invention will now be described. When it is desired to drive the fluid motor M, which is connected to a crane swing table, valve 128 is moved out of the centered position. This causes pressurized control fluid to be supplied to port 125. Fluid in port 125 passes through bore 130, drilled passage 131 and bore 132 to engage the end 111 of control piston 102. Control piston 102 moves an amount of its displacement which is proportional to the pressure of the control fluid. The springs 118, 118' in cartridge assemblies 113, 113' can be sized so that control piston 102 will move anywhere between the minimum and maximum displacement positions when pressurized control fluid is supplied to it. As control piston 102 moves out of the neutral position, input shaft 40 is rotated to put the pump on stroke.

At the same time as the pump is put on stroke by the pressurized control fluid, this fluid passes through orifice 134 and engages end 135 of piston 136. The control fluid moves pilot piston 136 to the left and seats cone 142 against the end 143 of bore 144. This sets the sequence valve 69 at a value which is proportional to the pressure of the control fluid.

It can be seen that the crane swing control 84 is really a torque control, since the pressurized control fluid from pressure reducer valve 128 sets both the displacement and maximum working pressure of the pump. In the event the maximum pressure of the pump exceeds the setting of the sequence valve 69, the working pressure fluid will begin to flow through port 85, passage 145 and bore 144 and unseat cone 142. The fluid will flow into a chamber 149 which surrounds cone 142 and exhaust through a passage 150 connected to a port 151. Port 151 is connected to fluid motor chamber 32 through lines 152, 97. In this way the working pressure fluid acts against vane 26 to thereby reduce the displacement of the pump until the setting of sequence valve 69 by pilot piston 136 is just maintained. In the event the amount of working pressure fluid that must be spilled exceeds that which can be accommodated by passage 145 and bore 144, the poppet 71 of sequence valve 69 will lift off seat 93. This excess fluid will flow into line 97 and help to more rapidly reduce the displacement of the pump.

When it is desired to slow or stop the movement of the crane swing table, the pressure reducer valve 128 is moved to the neutral (zero pressure) position. When the control fluid pressure is zero, spring 114 of cartridge assembly 113 biases the control piston 102 to the zero displacement position to put the pump off stroke and the pressure on the end 135 of piston 136 drops to zero which sets the sequence valve 69 at zero. This permits the motor M to free-wheel and follow a load. To stop the crane swing table, the operator simply moves the proportional pressure reducer valve 128 to put the pump on stroke in the direction opposing the fluid motor M. The operator simply puts the pump on stroke an amount sufficient to slow the fluid motor M and retard the movement of the swing table, but not sufficient to enable the load to move out from under the crane.

From the above it can be seen that the crane swing control 84 of the instant invention provides a control which sets the output torque of a pump which drives a fluid motor connected to a crane swing table when the crane is being driven and reduces the torque of the pump to zero to thereby permit the fluid motor to freely rotate when the pressure of the control fluid to the crane swing control 84 is zero.

Obviously, those skilled in the art may make various changes in the detailed arrangement of the parts without departing from the spirit and scope of the invention as it is defined by the claims hereto appended.

We claim:

1. A variable displacement pump driven by a prime mover comprising: fluid motor means for setting the displacement of the pump between a position of maximum displacement in one direction and a position of maximum displacement in the other direction with a centered position of minimum fluid displacement therebetween; input control means for operating the fluid motor means to set the displacement at a desired value; adjustable sequence valve means for setting and limiting working fluid pressure including an adjustable pilot stage, a poppet and a seat; means biasing the poppet toward the seat to close the sequence valve; conduit means conducting working fluid to the top and bottom of the poppet; an orifice in the conduit means which causes the sequence poppet to lift off the seat when the pressure drop across the orifice reduces the force on top of the poppet by an amount equal to the force of the biasing means; and means for automatically reducing pump displacement when working fluid pressure equals the pressure setting of the sequence valve means and the sequence poppet lifts off the seat; characterized by a swing control comprising a control piston, means connecting the control piston to the input control means, spring means for biasing the control piston to a centered position to thereby put the input control means in the centered position, second pilot valve means for limiting working fluid pressure including a second seat and a movable member, passage means for connecting the second pilot valve means to the conduit means between the orifice and the top of the sequence valve poppet, second passage means for connecting the second pilot valve means to said means for automatically reducing pump displacement, means for providing a source of pressurized control fluid to the swing control wherein said control fluid moves the control piston to thereby move the input control means to set the displacement of the pump to a position proportional to the pressure of the control fluid, wherein said control fluid acts on the movable member of the second pilot valve means to set the working fluid pressure at an amount proportional to the pressure of the control fluid and said movable member moves off said second seat to pass working pressure fluid to said second passage means to reduce the displacement of the pump when the pressure of the working fluid equals the setting of the second pilot valve means, and said sequence poppet lifts off the seat after the movable member moves off the second seat when the pressure drop across the orifice reduces the force on top of the poppet by an amount equal to the force of the biasing means to thereby help to further reduce the displacement of the pump.

2. The variable displacement pump of claim 1, further characterized by said movable member including a cone, a piston operating the cone, a seal interposed between said cone and said piston, and an isolation chamber connected to low pressure formed between the seal and the piston.

* * * * *